US007935276B2

(12) United States Patent
Zhou et al.

(10) Patent No.: US 7,935,276 B2
(45) Date of Patent: May 3, 2011

(54) POLYMERIC MATERIALS INCORPORATING CARBON NANOSTRUCTURES

(75) Inventors: Bing Zhou, Cranbury, NJ (US); Cheng Zhang, Lawrenceville, NJ (US); Martin Fransson, Princeton, NJ (US); Raymond B. Balée, Malvern, NJ (US)

(73) Assignee: Headwaters Technology Innovation LLC, Lawrenceville, NJ (US)

( * ) Notice: Subject to any disclaimer, the term of this patent is extended or adjusted under 35 U.S.C. 154(b) by 1081 days.

(21) Appl. No.: 11/614,006

(22) Filed: Dec. 20, 2006

(65) Prior Publication Data

US 2010/0133481 A1 Jun. 3, 2010

Related U.S. Application Data

(60) Provisional application No. 60/921,484, filed on Feb. 9, 2006.

(51) Int. Cl.
*H01B 1/06* (2006.01)

(52) U.S. Cl. ..... 252/511; 252/500; 252/502; 252/510; 524/495; 977/734; 977/735; 977/753; 977/773; 977/775; 977/778; 977/780; 977/783; 977/784; 977/788

(58) Field of Classification Search ..... 252/500–511; 524/495; 977/734, 735, 753, 773, 775, 778, 977/780, 783, 784, 788
See application file for complete search history.

(56) References Cited

U.S. PATENT DOCUMENTS

| | | | | |
|---|---|---|---|---|
| 4,336,238 | A | 6/1982 | Dalton, Jr. et al. | 423/584 |
| 4,347,231 | A | 8/1982 | Michaelson | 423/584 |
| 4,347,232 | A | 8/1982 | Michaelson | 423/584 |
| 4,374,105 | A | 2/1983 | Anderson et al. | 423/230 |
| 5,296,543 | A | 3/1994 | Kasowski et al. | |
| 5,462,680 | A | 10/1995 | Brois et al. | |
| 5,591,312 | A | 1/1997 | Smalley | 204/157.41 |
| 5,612,021 | A | 3/1997 | Mellul | |
| 5,643,990 | A | 7/1997 | Uehara et al. | 524/496 |
| 5,830,326 | A | 11/1998 | Iijima | 204/173 |
| 5,882,621 | A | 3/1999 | Doddapaneni et al. | |
| 5,882,810 | A | 3/1999 | Mussell et al. | |
| 6,231,980 | B1 | 5/2001 | Cohen et al. | 428/403 |
| 6,515,845 | B1 | 2/2003 | Oh et al. | 361/502 |

(Continued)

FOREIGN PATENT DOCUMENTS

EP 0544513 6/1993

(Continued)

OTHER PUBLICATIONS

Li, et al., "Carbon Nanotubes as Support for Cathode Catalyst of a Direct Methanol Fuel Cell," *Letters to the Editor/Carbon 40*, Dalian University of Technology, pp. 791-794 (Jan. 18, 2002).

(Continued)

*Primary Examiner* — Mark Kopec
*Assistant Examiner* — Tri V Nguyen
(74) *Attorney, Agent, or Firm* — Workman Nydegger

(57) ABSTRACT

The present invention relates to novel composites that incorporate carbon nanospheres into a polymeric material. The polymeric material can be any polymer or polymerizable material compatible with graphitic materials. The carbon nanospheres are hollow, graphitic nanoparticles. The carbon nanospheres can be manufactured from a carbon precursor using templating catalytic nanoparticles. The unique size, shape, and electrical properties of the carbon nanospheres impart beneficial properties to the composites incorporating these nanomaterials.

25 Claims, 6 Drawing Sheets

U.S. PATENT DOCUMENTS

| | | | | |
|---|---|---|---|---|
| 6,551,960 | B1 | 4/2003 | Laine et al. | 502/327 |
| 6,589,312 | B1 | 7/2003 | Snow et al. | 75/245 |
| 6,673,953 | B2 | 1/2004 | Keller et al. | 556/143 |
| 6,683,783 | B1 | 1/2004 | Liu et al. | 361/502 |
| 6,689,835 | B2 | 2/2004 | Amarasekera et al. | 524/495 |
| 6,692,718 | B1 | 2/2004 | Osawa | 423/448 |
| 6,712,864 | B2 | 3/2004 | Horiuchi et al. | 23/314 |
| 6,756,026 | B2 | 6/2004 | Colbert et al. | |
| 6,835,591 | B2 | 12/2004 | Rueckes et al. | 438/99 |
| 6,841,509 | B1 | 1/2005 | Hwang et al. | |
| 6,866,801 | B1 | 3/2005 | Mau et al. | 264/29.1 |
| 6,936,233 | B2 | 8/2005 | Smalley et al. | |
| 2002/0192141 | A1 | 12/2002 | Little | 423/447.3 |
| 2003/0004058 | A1 | 1/2003 | Li et al. | 423/447.3 |
| 2003/0100653 | A1 | 5/2003 | Chacko | 524/99 |
| 2003/0166762 | A1 | 9/2003 | Koevoets et al. | 523/351 |
| 2003/0185741 | A1 | 10/2003 | Matyjaszewski et al. | 264/29.2 |
| 2004/0005269 | A1 | 1/2004 | Huang et al. | 423/447.3 |
| 2004/0009346 | A1* | 1/2004 | Jang et al. | 428/336 |
| 2004/0047798 | A1 | 3/2004 | Oh et al. | 423/445 R |
| 2004/0069454 | A1 | 4/2004 | Bonsignore et al. | |
| 2004/0110005 | A1 | 6/2004 | Choi et al. | 428/408 |
| 2004/0130066 | A1* | 7/2004 | Koide et al. | 264/255 |
| 2004/0136894 | A1 | 7/2004 | Yoshizawa et al. | 524/495 |
| 2004/0141906 | A1 | 7/2004 | Polverejan et al. | 423/418.2 |
| 2004/0176513 | A1 | 9/2004 | Cakmak et al. | |
| 2004/0185251 | A1 | 9/2004 | Wang et al. | 428/689 |
| 2004/0214177 | A1 | 10/2004 | Bension | 435/6 |
| 2004/0224163 | A1 | 11/2004 | Tobita et al. | 428/413 |
| 2004/0234444 | A1 | 11/2004 | Shaffer et al. | |
| 2005/0009694 | A1 | 1/2005 | Watts et al. | |
| 2005/0016839 | A1 | 1/2005 | Horne et al. | 428/248.1 |
| 2005/0032635 | A1 | 2/2005 | Yu et al. | |
| 2005/0037255 | A1 | 2/2005 | Ozaki et al. | 429/128 |
| 2005/0039382 | A1 | 2/2005 | Blanchard et al. | |
| 2005/0049355 | A1 | 3/2005 | Tang et al. | 524/496 |
| 2005/0070657 | A1 | 3/2005 | Elkovitch et al. | 524/495 |
| 2005/0127782 | A1 | 6/2005 | Endo et al. | 310/323.02 |
| 2005/0128884 | A1 | 6/2005 | Endo et al. | 368/160 |
| 2005/0136079 | A1 | 6/2005 | Burangulov et al. | |
| 2005/0142428 | A1 | 6/2005 | Daimon et al. | |
| 2005/0147746 | A1 | 7/2005 | Dubin et al. | |
| 2005/0170169 | A1 | 8/2005 | Watanabe et al. | 428/292.1 |
| 2005/0181285 | A1 | 8/2005 | Sakamoto et al. | |
| 2005/0228109 | A1 | 10/2005 | Chandra et al. | 524/495 |
| 2005/0245667 | A1 | 11/2005 | Harmon et al. | 522/116 |
| 2006/0062712 | A1 | 3/2006 | Pak et al. | |
| 2006/0133981 | A1 | 6/2006 | Jaroniec et al. | |
| 2006/0137487 | A1* | 6/2006 | McKinnon et al. | 75/252 |
| 2006/0155376 | A1* | 7/2006 | Asgari | 623/16.11 |

FOREIGN PATENT DOCUMENTS

| | | |
|---|---|---|
| EP | 0852246 | 7/1998 |
| EP | 1502609 | 2/2005 |
| EP | 1655266 | 5/2006 |
| JP | 8325504 | 12/1996 |
| JP | 2002338219 | 11/2002 |
| JP | 2003054922 | 2/2003 |
| JP | 2004339041 | 2/2004 |
| JP | 2004224579 | 8/2004 |
| JP | 2004331929 | 11/2004 |
| JP | 2004339407 | 12/2004 |
| JP | 2005074472 | 3/2005 |
| JP | 2005133047 | 5/2005 |
| WO | WO 00/24816 | 5/2000 |
| WO | WO2004/087565 | 10/2004 |
| WO | WO2005/023708 | 3/2005 |
| WO | WO2005023708 * | 3/2005 |
| WO | WO2005089390 | 9/2005 |

OTHER PUBLICATIONS

Li, et al., "Preparation and Characterization of Multiwalled Carbon Nanotube-Supported Platinum for Cathode Catalysts of Direct Methanol Fuel Cells," *J. Phys. Chem*, B, vol. 107, pp. 6292-6299 (Jun. 6, 2003).

Lordi, et al., "Method for Supporting Platinum on Single-Walled Carbon Nanotubes for a Selective Hydrogenation Catalyst," *Chem. Mater.*, vol. 13, pp. 733-737 (Feb. 10, 2001).

Ohtsuka, Yasui, et al., "Char-Nitrogen Functionality and Interactions Between the Nitrogen and Iron I the Iron-Catalyzed Conversion Process of Coal Nitrogen to $N^2$," Research Center for Organic Resources and Materials Chemistry, Institute for Chemical Reaction Science, Tohoku University, Sendai, Japan, pp. 1356-1362 (May 6, 1998).

Matsumoto, et al., "Reduction of Pt usage in fuel cell electrocatalysts with carbon nanotube electrodes," *Chem. Commun., The Royal Society of Chemistry* 2004, 2004, pp. 840-841.

Li, et al., "Homogeneous and controllable Pt particles deposited on multi-wall carbon nanotubes as cathode catalyst for direct methanol fuels cells," *Letters to the Editor/Carbon 42*, Dalian University of Technology, pp. 436-439 (2004).

Han, Sangjin, et al., "Simple Solid-Phase Synthesis of Hollow Graphitic Nanoparticles and their Appliation to Direct Methanol Fuel Cell Electrodes," *Adv. Mater.* 2003, 15, No. 22, Nov. 17, pp. 1922-1925.

Hod, Oded, et al., "Carbon nanotube closed-ring structures", *Physical Review*, B 67, 195408 (2003).

Wang, Zhong L., et al., "A rich family of slinky materials," *Materials Today*, Apr. 2004, p. 7.

Zhen Liu, et al., "Formation of nanoparticles rings on heterogeneous soft surfaces," *IOP Electronic Journals*, Nanotechnology, 11 (Nov. 2004).

Bell, Linda, Editor/Publisher, *Nanotech Briefs*, vol. 1, No. 1, (Jan. 2004); www.nanotechbriefs.com.

Drzal, Lawrence T., "Nanotechnology Applications for Green Manufacturing," Michigan State University, College of Engineering, CMSC, Aug. 18, 2004.

Hester, J.R., et al., "Nanoparticle-templated carbon nanotube ring nucleus formation," *Applied Physics Letters*, (Apr. 8, 2002) vol. 80, No. 14, p. 2580-2.

Ibarra, M. R., "Magnetism of Nanometric 3d-Metal Particles in Carbon Cages: Possible Relevance for Biomedical Applications," presentation, Jun. 12, 2003.

Yong, K. Kim, et al., Nanocomposite Fibers, National Textile Center Annual Report: Nov. 2003; pp. 1-9.

Developing Application in Plastics, Nanotubes as a Conductive Additive in Elastomers; Hyperion Catalysis; http://www.fibrils.com/developing2.htm.

Max Planck Research, Spicing up Styrene with Nano-Onions; Jan. 2003.

Bagci, V.M.K., "Metal nanoring and tube formation on carbon nanotubes", Dept. of Phys., Bilkent Univ., Ankara, Turkey.

Kuznetsova, A., et al., Physical adsorption of xenon in open single walled carbon nanotubes: Observation of a quasi-one-dimensional confined Xe phase, Journal of Chemical Physics, vol. 112, No. 21, 9590-9598, Jun. 1, 2000.

Mawhinney, Douglas B., et al., "Infared Spectral Evidence for the Etching of Carbon Nanotubes: Ozone Oxidation at 298 K", J. Am. Chem. Soc. (2000), 122, 2383-2384, published on web Feb. 29, 2000.

Kuznetsova, A., et al., "Enhancement of adsorption inside of single-walled nanotubes: opening the entry ports", Chemical Physics Letters 321, (2000), 292-296.

Kuznetsova, A., et al., "Oxygen-Containing Functional Groups on Single-Wall Carbon Nanotubes: NEXAFS and Vibrational Spectroscopic Studies", J. Am. Chem. Soc. (2001), 123, 10699-10704, published on web Oct. 9, 2001.

Fuertes, Antonio B. and Centeno, Teresa A., "Mesoporous carbons with graphitic structures fabricated by using porous silica materials as templates and iron-impregnated polypyrrole as precursor", J. Mater. Chem, (2005), 15, 1079-1083.

Guozhang, W., et al., "Entropy Penalty-Induced Self-Assembly in Carbon Black or Carbon Fiber Filled Polymer Blends", Macromolecules, (2002), vol. 35, No. 3, 945-951, published on the web Dec. 29, 2001.

Simonyan, Vahan V. and Johnson, J. Karl, "Hydrogen storage in carbon nanotubes and graphitic nanofibers", Journal of Alloys and Compounds, 330-332, (2002), 659-665.

Carmona, François and Ravier, Jérôme, "Electrical properties and mesostructure of carbon black-filled polymers", Pergamon, Carbon 40, (2002), 151-156.
Behler, K., et al., "Effect of thermal treatment on the structure of multi-walled carbon nanotubes", Journal of Nanoparticle Research, (2006), DOI 10/1007/s11051-006-9113-6.
Hyperion Catalysis, "Preservation of Physical Properties in Molded Parts Using Compounds with FIBRIL™ Nanotubes", Hyperion Catalysis International Inc. website www.hyperioncatalysis.com, Article available as of at least Nov. 2006.
Hu, et al., "Direct Synthesis of Uniform Hollow Carbon Spheres by a Self-Assembly Template Approach" *The Royal Society of Chemistry 2002*, pp. 1948-1949 (Aug. 1, 2002).
Xu, et al., "A Novel Route to Hollow and Solid Carbon Spheres" *Letters to the Editor / Carbon* 43(2005), pp. 1090-1092 (Jan. 6, 2005).
Yoshizawa, et al., "TEM and Electron Tomography Studies of Carbon Nanospheres for Lithium Secondary Batteries" *Science Direct* 44(2006), pp. 2558-2564, (Jul. 14,2006).
Wu, et al., "Necklace-like Hollow Carbon Nanospheres from the Pentagon-Including Reactants: Synthesis and Electrochemical Properties" *Inorganic Chemistry*, vol. 45, pp. 8543-8550 (Nov. 21, 2006).
Sun et al., "Colloidal Carbon Spheres and Their Core/Shell Structures with Noble-Metal Nanoparticles", Angewandte Chemie International Edition, Wiley-VCH Verlag GmbH & Co. KGaA, 2004, vol. 43, Issue 5, pp. 597-6501.
Qiao et al., "Carbon nanospheres produced in an arc-discharge process", Carbon 44 (2006) 158-193, available online Sep. 13, 2005.
Garrigue et al., "Top-Down Approach for the Preparation of Colloidal Carbon Nanoparticles", Chemical Materials 2004, 16, 2984-2986, available online Jul. 17, 2007.
Mukhopadhyay, Kingsuk, "Bulk Production of quasi aligned carbon nanotube bundles by the catalytic chemical vapour deposition (ccvd) method", Apr. 2, 1999, Chemical Physics Letters, vol. 303, pp. 117-124.
T. Hyeon et al., Angew. Chem, Int. Ed. 2003, 42, 4352-4356.
Office Action dated Jan. 21, 2009 cited in U.S. Appl. No. 11/244,521.
Office Action dated Nov. 6, 2009 cited in U.S. Appl. No. 11/244,521.
Office Action dated Jul. 9, 2010 cited in U.S. Appl. No. 11/244,521.
Office Action dated Nov. 12, 2008 cited in U.S. Appl. No. 11/539,120.
Office Action dated Apr. 8, 2009 cited in U.S. Appl. No. 11/539,120.
Office Action dated Sep. 10, 2009 cited in U.S. Appl. No. 11/539,120.
Office Action dated Mar. 1, 2010 cited in U.S. Appl. No. 11/539,120.
Office Action dated Nov. 6, 2008 cited in U.S. Appl. No. 11/539,042.
Office Action dated Apr. 8, 2009 cited in U.S. Appl. No. 11/539,042.
Office Action dated Aug. 14, 2009 cited in U.S. Appl. No. 11/539,042.
Notice of Allowance dated Jan. 13, 2010 cited in U.S. Appl. No. 11/539,042.
Office Action dated Oct. 4, 2010 cited in U.S. Appl. No. 11/539,120.
Notice of Allowance dated Nov. 5, 2010 cited in U.S. Appl. No. 11/539,120.

* cited by examiner

POLYMERIC MATERIALS INCORPORATING CARBON NANOSTRUCTURES

CROSS-REFERENCE TO RELATED APPLICATION

This application claims the benefit of U.S. Provisional Application No. 60/921,484, which was converted from U.S. application Ser. No. 11/351,620, filed Feb. 9, 2006, the disclosure of which is incorporated herein in its entirety.

BACKGROUND OF THE INVENTION

1. The Field of the Invention

The invention relates generally to polymeric materials incorporating a carbon nanomaterial. More particularly, the present invention relates to polymeric materials incorporating carbon nanospheres;

2. The Related Technology

Carbon materials have been used in a variety of fields as high-performance and functional materials. Graphite is a well-known carbon material that has important properties such as conductivity and inertness. In the past decade, researchers have learned to manufacture graphitic structures on a nanometer scale. The most widely researched and understood graphitic nanostructures are carbon nanotubes. Recently, researchers have developed methods of making other carbon nanostructures such as carbon "nano-onions," "nanohorns," "nanobeads," "nanofibers," etc.

Some of these materials have been used to make composites by incorporating the nanostructures into polymeric materials. Most of these efforts have been directed toward incorporating single- and multi-walled nanotubes in polymers. Using carbon nanotubes as filler materials in polymers can be advantageous by increasing the strength of the composite material and making the composite material conductive.

However, incorporating carbon nanotubes into polymeric materials has proved to be very challenging. The fibrous shape of the carbon nanotubes combined with their small size makes them difficult to uniformly disperse in polymers. For applications where conductivity is desired, the amount of carbon nanotubes that is required to impart a meaningful reduction in electrical resistance is cost prohibitive for most applications.

BRIEF SUMMARY OF THE INVENTION

The present invention relates to novel composites that incorporate a carbon nanomaterial into a polymeric material. The carbon nanomaterial includes carbon nanostructures that give the polymeric composites novel properties. In one embodiment of the invention, the carbon nanostructures incorporated into the polymeric material are carbon nanospheres. The carbon nanospheres typically have multiple walls of graphite that define a generally round, hollow nanoparticle.

The nanospheres can be made in various sizes. In one embodiment, the outer diameter is in a range from about 2 nm to about 500 nm, more preferably from about 5 nm to about 250 nm, and most preferably from about 10 nm to about 150 nm. The inside diameter of the nanospheres depends on the outer diameter of the nanosphere and the wall thickness. The inside diameter (i.e., the diameter of the hollow portion) is typically between about 0.5 nm and about 300 nm, more preferably between about 2 nm and about 200 nm, and most preferably between about 5 nm and about 100 nm.

Optionally the carbon nanomaterial can be treated to make the nanomaterial more dispersable in a polymeric material and/or to remove functional groups (e.g., acidic groups) from its surface. In one embodiment, carboxylic acid and other oxygenated functional groups are removed using a neutralizing base. In an alternative embodiment, the dispersability of the nanomaterial is improved by heat treating the material after it has been purified with oxidative agents.

The polymeric material used to make the composite can be any polymer or polymerizable material compatible with graphitic materials. Example polymers include polyamines, polyacrylates, polybutadienes, polybutylenes, polyethylenes, polyethylenechlorinates, ethylene vinyl alcohols, fluoropolymers, ionomers, polymethylpentenes, polypropylenes, polystyrenes, polyvinylchlorides, polyvinylidene chlorides, polycondensates, polyamides, polyamide-imides, polyaryletherketones, polycarbonates, polyketones, polyesters, polyetheretherketones, polyetherimides, polyethersulfones, polyimides, polyphenylene oxides, polyphenylene sulfides, polyphthalamides, polythalimides, polysulfones, polyarylsulfones, allyl resins, melamine resins, phenol-formaldehyde resins, liquid crystal polymers, polyolefins, silicones, polyurethanes, epoxies, polyurethanes, cellulosic polymers, combinations of these, derivatives of these, or copolymers of any of the foregoing. The polymerizable materials can be a polymer or a polymerizable material such as a monomer, oligomer, or other polymerizable resin.

The carbon nanospheres are mixed with the polymeric material in a range of about 0.1% to about 70% by weight of the composite, more preferably in a range of about 0.5% to about 50% by weight, and most preferably in a range of about 1.0% to about 30%. The carbon nanospheres can be added alone or in combination with other graphitic materials to give the composite conductive properties. To impart electrical conductivity, it is preferable to add more than about 3% by weight of carbon nanospheres in the composite, more preferably greater than about 10% by weight, and most preferably greater than about 15%.

As a method for producing the composite of the present invention, any known method can be used. For example, pellets or powder of the polymeric material and a desired amount of the carbon nanospheres can be dry-blended or wet-blended and then mixed in a roll kneader while heated, or fed in an extrusion machine to extrude as a rope and then cut into pellets. Alternatively, the carbon nanospheres can be blended in a liquid medium with a solution or dispersion of the resin. When a thermosetting polymerizable material is used, the carbon nanospheres can be mixed with a monomer or oligomer using any known method suitable for the particular resin.

Compared to other nanomaterials, particularly nanotubes, which are fiber-like in shape, nanospheres are much easier to disperse within polymeric or polymerizable materials owing to their more spheroidal shape. This allows nanospheres to be dispersed more easily like a particulate filler rather than a fibrous material. Fibrous materials are typically much more difficult to disperse than particles and require much higher shearing forces to ensure good dispersion. Nanospheres, in contrast, can be blended with polymeric and polymerizable materials using lower shear. Using lower shear to blend nanospheres is less likely to degrade the graphitic material and the polymeric materials into which it is dispersed.

To improve dispersion of the nanospheres in a polymeric material, any known methods and/or materials suitable for use with graphitic carbon can be used. Further, as a method for molding into a desired shape, any known method such as extrusion molding, blow molding, injection molding, or press molding can be used.

The composite materials of the present invention can have beneficial properties that result from the unique shape, chemistry and other features of the carbon nanospheres incorporated therein. In particular it has been found that carbon nanospheres can reduce the electrical resistance of many polymers significantly more than a comparable amount of carbon nanotubes or carbon black. For example, where about 16 wt % of carbon black or 7 wt % carbon nanotubes in a polymeric material will achieve a desired low electrical resistance, surprisingly, only about 3 wt % of carbon nanospheres is needed to achieve the same desired low electrical resistance.

These and other advantages and features of the present invention will become more fully apparent from the following description and appended claims as set forth below.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF EXAMPLE EMBODIMENTS

Figure 1A:
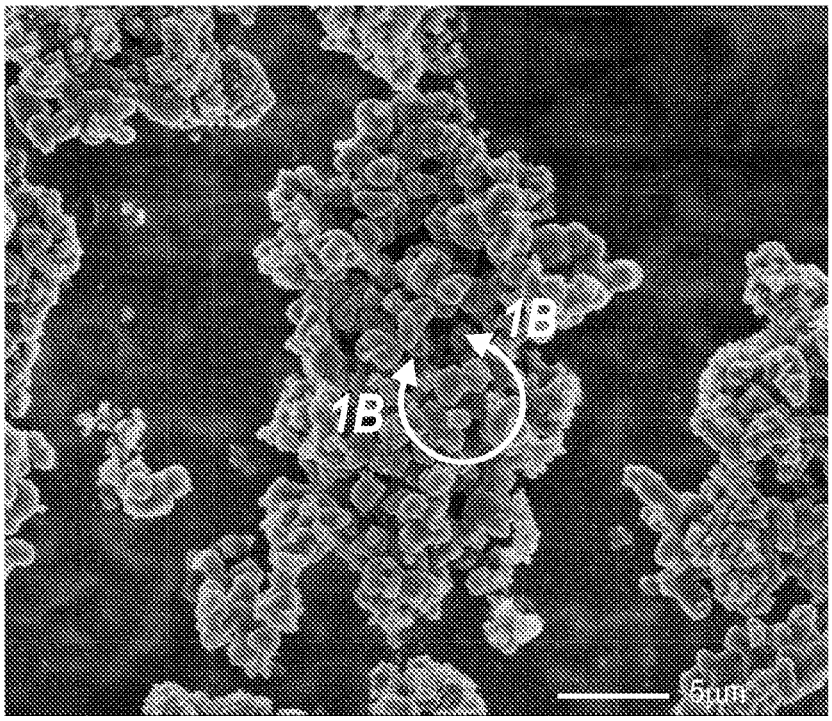
FIG. 1A is a high resolution SEM image of a carbon nanomaterial formed according to an embodiment of the present invention, which includes a plurality of nanosphere clusters.

I. Components Used to Manufacture the Composites

The composite polymeric materials of the invention include a mixture of a polymeric material and a carbon nanomaterial. The carbon nanomaterial includes carbon nanospheres, which give the composite novel properties such as reduced electrical resistance. Optionally, the composite polymeric materials can also include other additives such as fillers or other carbon nanomaterials. For purposes of this invention, the term nanosphere includes graphitic, hollow particles or balls that have a regular or irregular outer shape.

A. Polymeric Materials

Any polymeric material that is compatible or can be made to be compatible with graphitic materials can be used in the novel composites of the present invention. The polymeric material can be a polymer or a polymerizable material. The polymeric material can be a synthetic, natural, or modified natural polymer or resin. Suitable polymeric materials include thermoset and thermoplastic polymers and/or polymerizable materials.

Suitable polymeric materials useful in the composites of the present invention include the following polymers (and/or polymerizable materials selected to form one or more of the following polymers): polyamines, polyacrylates, polybutadienes, polybutylenes, polyethylenes, polyethylenechlorinates, ethylene vinyl alcohols, fluoropolymers, ionomers, polymethylpentenes, polypropylenes, polystyrenes, polyvinylchlorides, polyvinylidene chlorides, polycondensates, polyamides, polyamideimides, polyaryletherketones, polycarbonates, polyketones, polyesters, polyetheretherketones, polyetherimides, polyethersulfones, polyimides, polyphenylene oxides, polyphenylene sulfides, polyphthalamides, polythalimides, polysulfones, polyarylsulfones allyl resins, melamine resins, phenol-formaldehyde resins, liquid crystal polymers, polyolefins, silicones, polyurethanes, epoxies, polyurethanes, cellulosic polymers, combinations of these, derivatives of these, or copolymers of any of the foregoing.

The polymeric material can be a thermoplastic polymer that is heated and then mixed with the carbon nanospheres. Alternatively, a thermoset polymer can be used. Typically a thermoset polymer is provided as one or more polymerizable monomers or oligomers and then mixed with the carbon nanospheres and polymerized to form the composite.

Those skilled in the art are familiar with the monomers and/or oligomers that can be used to form the foregoing polymers. For example polyurethanes are derived from a reaction between an isocyanate group and a hydroxyl group; polyureas are derived from the reaction between an isocyanate and an amine; silicones can be derived from the hydrolysis of silanes and/or siloxanes, etc. The present invention also includes copolymers that include blocks of one or more of the polymers listed above. Additional polymers and polymerizable materials are disclosed in U.S. Pat. No. 6,689,835, which is incorporated herein by reference.

Examples of suitable thermo-plastic polymerizable materials include acrylonitrile-butadiene-styrene, acrylonitrile-ethylene/propylene-styrene, methylmethacrylate-butadiene-styrene, acrylonitrile-butadiene-methylmethacrylatestyrene, acrylonitrile-n-butylacrylate-styrene, rubber modified polystyrene (high impact polystyrene), polyethylene, polypropylene, polystyrene, polymethylmethacrylate, polyvinylchloride, cellulose-acetate, polyamide, polyester, polyacrylonitrile, polycarbonate, polyphenyleneoxide, polyketone, polysulphone, polyphenylenesulfide, fluoride resin, silicone, polyimide, polybenzimidazole, polyamide elastomer, combinations thereof, and derivatives thereof, and the like.

Examples of suitable thermo-setting resins include phenol resin, urea resin, melamine-formaldehyde, urea-formaldehyde latex, xylene resin, diallylphthalate resin, epoxy resin, aniline resin, furan resin, silicon resin, polyurethane resin, combinations thereof, derivatives thereof, and the like.

B. Carbon Nanomaterials

A carbon nanomaterial is included in the composite material to give the composite desired properties. The novel properties of the composite are due, at least in part, to carbon nanostructures that make up all or a part of the carbon nanomaterial. The carbon nanostructures within the carbon nanomaterial have useful properties such as unique shape, size, and/or electrical properties. In one embodiment, the carbon nanostructures are carbon, nanospheres.

The carbon nanomaterials can include materials other than carbon nanospheres. For example, the carbon nanomaterial can include graphite (i.e., graphitic sheets), amorphous carbon, and/or iron nanoparticles. The percentage of carbon nanospheres can affect the properties of the composite. In one embodiment, the weight percent of carbon nanospheres in the carbon nanomaterial is in a range from about 2% to about 100% by weight. Alternatively, the percent of carbon nanospheres is at least about 10 wt %, more preferably at least about 15%.

Alternatively, or in addition to the weight percent of carbon nanostructure, the novel carbon nanomaterials can be characterized by the absence of surface functional groups. In one embodiment, the functionalization of the carbon nanomaterial is determined by the acidity of an aqueous wash. In one embodiment, the carbon nanomaterials have an acid functionalization that gives a wash solution a pH in a range from about 5.0 to about 8.0, more preferably about 6.0 to about 7.5, and most preferably in a range from about 6.5 to about 7.25, based on a 1:1 weight ratio of washing solution to carbon nanomaterial. Carbon nanomaterials that have a pH in the foregoing ranges can be advantageously mixed with polymeric resins that are sensitive to acidic filler materials (e.g. polystyrene butadiene rubber). However, the invention includes carbon nanomaterials with a pH outside the foregoing ranges and, if desired, these carbon nanomaterials can be used with polymeric resins that are sensitive to acidic filler materials.

1. Carbon nanospheres

The carbon nanospheres can be regular or irregularly shaped hollow nanoparticles. In one embodiment, the carbon nanospheres are generally spheroidal in shape.

As described below, in one embodiment of the invention, the carbon nanostructures are manufactured from templating nanoparticles and a carbon precursor. During this process, the carbon nanostructures form around the templating nanoparticles. In this embodiment, the size and shape of the nanostructure is determined in large part by the size and shape of the templating nanoparticles. Because the carbon nanostructures form around the templating nanoparticles, the hole or inner diameter of the carbon nanostructures typically corresponds to the outer diameter of the templating nanoparticles. The inner diameter of the carbon nanostructures can be between 0.5 nm to about 90 nm.

Figure 1B:
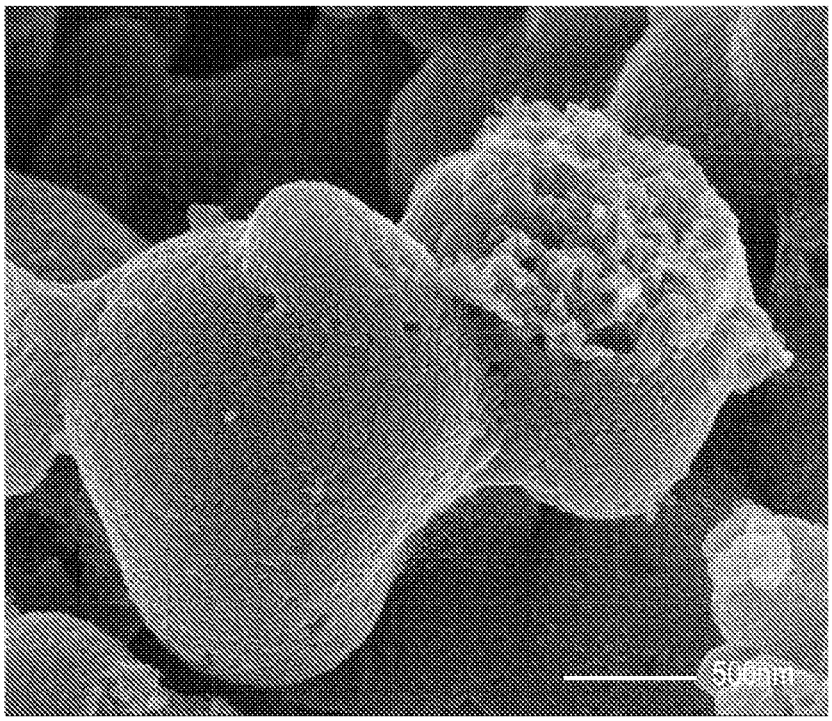
FIG. 1B is a high resolution SEM image showing a closer image of individual clusters of carbon nanostructures and showing one cluster that has been broken open to reveal the plurality of carbon nanostructures that make up the cluster.
Figure 2:
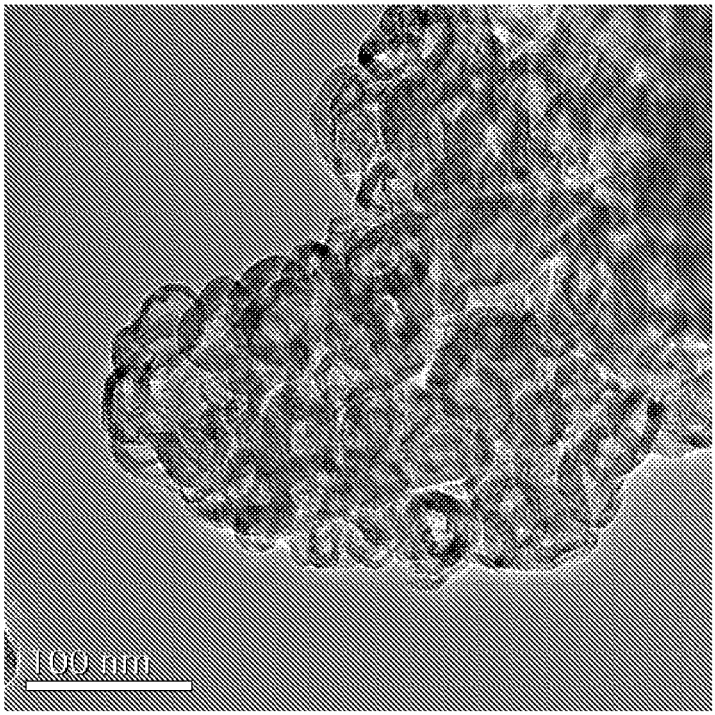
FIG. 2 is a high resolution TEM image of the carbon nanomaterial of FIG. 1A showing a plurality of carbon nanostructures agglomerated together and revealing the multi-walled and hollow nature of the carbon nanostructures that form a cluster.
Figure 3:
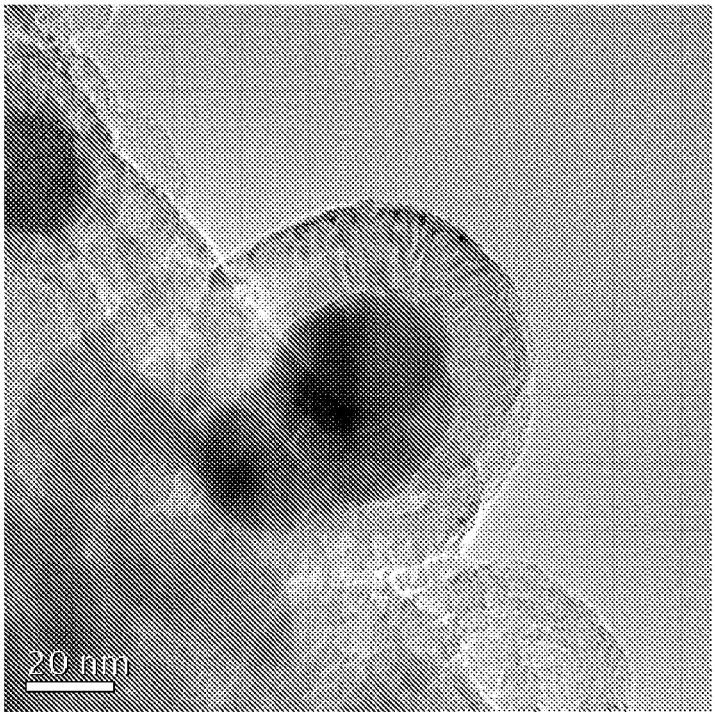
FIG. 3 is a high resolution TEM image showing a close up of a carbon nanostructure that has a catalytic templating nanoparticle in its center.

FIGS. 1A and 1B show SEM images of example nanospheres made using catalytic templating nanoparticles, the details of which are described in Example 1 below. FIGS. 2 and 3 are TEM images of the nanomaterial shown in FIGS. 1A and 1B. The TEM images interpreted in light of the SEM images show that in one embodiment the nanospheres can have a generally spheroidal shape.

In FIG. 1A, the SEM image reveals that, at least in some embodiments, the carbon nanomaterial includes spheroidal or "grape-like" clusters of carbon nanospheres. FIG. 1B is a close-up of a cluster of carbon nanospheres that has been partially broken open thereby exposing a plurality of carbon nanospheres. The TEM image in FIG. 2 further shows that the clusters are made up of a plurality of smaller nanospheres. The cluster of nanospheres in FIG. 2 reveals that the nanostructures are hollow and generally spheroidal.

FIG. 3 is an even closer view of a carbon nanosphere that appears to have an iron templating nanoparticle remaining in its center. The carbon nanospheres of FIG. 3 illustrates that the formation of the carbon nanostructures occurs around the catalytic templating nanoparticles.

In many of the carbon nanospheres observed in TEM images, the outer diameter of the nanospheres is between about 10 nm and about 60 nm and the hollow center diameter is about 10 nm to about 40 nm. However, the present invention includes nanostructures having larger and smaller diameters. Typically, the carbon nanospheres have an outer diameter that is less than about 100 nm to maintain structural integrity.

The thickness of the nanosphere wall is measured from the inside diameter of the wall to the outside diameter of the wall. The thickness of the nanostructure can be varied during manufacture by limiting the extent of polymerization and/or carbonization of the carbon precursor as described below. Typically, the thickness of the carbon nanosphere wall is between about 1 nm and 20 nm. However, thicker and thinner walls can be made if desired. The advantage of making a thicker wall is greater structural integrity. The advantage of making a thinner wall is greater surface area and porosity.

The wall of the carbon nanostructure can also be formed from multiple graphitic layers. In an exemplary embodiment, the carbon nanospheres have walls of between about 2 and about 100 graphite layers, more preferably between about 5 and 50 graphite layers and more preferably between about 5 and 20 graphite layers. The graphitic characteristic of the carbon nanostructures is believed to give the carbon nanostructures beneficial properties that are similar to the benefits of multi-walled carbon nanotubes (e.g., excellent conductivity). The carbon nanospheres can be substituted for carbon nanotubes and used in many applications where carbon nanotubes can be used but often with predictably superior results and/or reduced costs.

While the SEM images and TEM images show nanostructures that are generally spherical, the present invention extends to nanostructures having shapes other than spheriodal. In addition, the nanostructures may be fragments of what were originally spheriodal shaped nanospheres. Typically the shape of the carbon nanostructure will be at least partially determined by the shape of the templating nanoparticles. Thus, formation of non-spherical templating nanoparticles can lead to carbon nanostructures with non-spheroidal dimensions.

In addition to good electron transfer, the carbon nanostructures of the present invention can have high porosity and large surface areas. Adsorption and desorption isotherms indicate that the carbon nanostructures form a mesoporous material. The BET specific surface area of the carbon nanostructures can be between about 80 and about 400 $m^2/g$ and is preferably greater than about 120 $m^2/g$, and typically about 200 $m^2/g$, which is significantly higher than the typical 100 $m^2/g$ observed for carbon nanotubes. Even where the methods of the invention results in carbon nanostructures combined with non-structured graphite, this graphitic mixture (i.e., the carbon nanomaterial) typically has a surface area greater than carbon nanotubes.

2. Methods For Manufacturing Carbon Nanomaterials

The carbon nanostructures of the present invention can be manufactured using all or a portion of the following steps: (i) forming a precursor mixture that includes a carbon precursor and a plurality of templating nanoparticles, (ii) allowing or causing the carbon precursor to polymerize around the catalytic templating nanoparticles, (iii) carbonizing the precursor mixture to form an intermediate carbon material that includes a plurality of nanostructures (e.g., carbon nanospheres), amorphous carbon, and catalytic metal, (iv) purifying the intermediate carbon material by removing at least a portion of the amorphous carbon and optionally a portion of the catalytic metal, and (v) optionally removing at least a portion of any functional groups that remain on the surface of the purified intermediate carbon material by heat treating the purified intermediate material and/or treating the purified intermediate material with a base.

(i) Forming a Precursor Mixture

The precursor mixture is formed by selecting a carbon precursor and dispersing a plurality of catalytic templating nanoparticles in the carbon precursor.

Any type of carbon material can be used as the carbon precursor of the present invention so long as it can disperse the templating particles and carbonize around the templating particles upon heat treating. Examples of suitable polymerizable carbon precursors include resorcinol-formaldehyde gel, resorcinol, phenol resin, melamine-formaldehyde gel, poly(furfuryl alcohol), poly(acrylonitrile), sucrose, petroleum pitch, and the like. Other polymerizable benzenes, quinones, and similar compounds can also be used as carbon precursors and are known to those skilled in the art. In an exemplary embodiment, the carbon precursor is a hydrothermally polymerizable organic compound. Suitable organic compounds of this type include citric acid, acrylic acid, benzoic acid, acrylic ester, butadiene, styrene, cinnamic acid, and the like.

The catalytic templating nanoparticles, which are dispersed in the carbon precursor, can be provided in several different ways. The templating nanoparticles can be formed in the carbon precursor (i.e., in-situ) or formed in a separate reaction mixture and then mixed with the carbon precursor. In some cases, particle formation may partially occur in a separate reaction and then be completed as the templating particles are mixed and/or heated in the carbon precursor (e.g., at the onset of a precursor polymerization step). The templating nanoparticles can also be formed using a dispersing agent that controls one or more aspects of particle formation or the templating nanoparticles can be made from metal salts.

In one embodiment, the templating nanoparticles are formed in the carbon precursor from a metal salt. In this embodiment, the templating nanoparticles are formed by selecting one or more catalyst metal salts that can be mixed with the carbon precursor. The metal salts are mixed with the carbon precursor and then allowed or caused to form nanoparticles in-situ.

In an alternative embodiment, the templating particles are formed (in-situ or ex-situ) using a dispersing agent to control particle formation. In this embodiment, one or more types of catalyst atoms and one or more types of dispersing agents are selected. The dispersing agent is selected to promote the formation of nanocatalyst particles that have a desired stability, size and/or uniformity. Dispersing agents within the scope of the invention include a variety of small organic molecules, polymers, and oligomers. The dispersing agent is able to interact and bond with catalyst atoms dissolved or dispersed within an appropriate solvent or carrier through various mechanisms, including ionic bonding, covalent bonding, Van der Waals interaction/bonding, lone pair electron bonding, or hydrogen bonding.

The catalyst atoms (e.g., in the form of a ground state metal or metal salt) and dispersing agent (e.g., in the form of a carboxylic acid or its salt) are reacted or combined together to form catalyst complexes. The catalyst complexes are generally formed by first dissolving the catalyst atoms and dispersing agent in an appropriate solvent and then allowing the catalyst atoms to bond with the dispersing agent molecules. The various components may be combined or mixed in any sequence or combination. In addition, a subset of the components can be premixed prior to addition of other components, or all components may be simultaneously combined.

In an embodiment of the invention, the components for the templating nanoparticles are allowed or caused to form nanoparticles by mixing the components for a period of about 1 hour to about 14 days. This mixing is typically conducted at temperatures ranging from 0° C. to 200° C. In one embodiment, the temperature does not exceed 100° C. Particle formation can also be induced using a reagent. For example, in some cases formation of particles or intermediate particles can be caused by bubbling hydrogen through the solution of catalyst complexes.

The templating nanoparticles of the present invention are capable of catalyzing polymerization and/or carbonization of the carbon precursor. The concentration of catalytic templating nanoparticles in the carbon precursor is typically selected to maximize the number of carbon nanostructures formed. The amount of catalytic templating particles can vary depending on the type of carbon precursor being used. In an example embodiment the molar ratio of carbon precursor to catalyst atoms is about 0.1:1 to about 100:1, more preferably about 1:1 to about 30:1. Examples of suitable catalyst materials include iron, cobalt, nickel, and the like.

(ii) Polymerizing the Precursor Mixture

The precursor mixture is typically allowed to cure for sufficient time such that a plurality of intermediate carbon nanostructures are formed around the templating nanoparticles. Because the templating nanoparticles are catalytically active, the templating nanoparticles can preferentially accelerate and/or initiate polymerization of the carbon precursor near the surface of the templating particles.

The time needed to, form intermediate nanostructures depends on the temperature, the type and concentration of the catalyst material, the pH of the solution, and the type of carbon precursor being used. During polymerization, the intermediate carbon nanostructures can be individual organic structures or an association of nanostructures that break apart during carbonization and/or removal of amorphous carbon.

Ammonia added to adjust the pH can also effect polymerization by increasing the rate of polymerization and by increasing the amount of cross linking that occurs between precursor molecules.

For hydrothermally polymerizable carbon precursors, polymerization typically occurs at elevated temperatures. In a preferred embodiment, the carbon precursor is heated to a temperature of about 0° C. to about 200° C., and more preferably between about 25° C. to about 120° C.

An example of a suitable condition for polymerization of resorcinol-formaldehyde gel (e.g., with iron particles and a solution pH of 1-14) is a solution temperature between 0° C. and 90° C. and a cure time of less than 1 hour to about 72 hours. Those skilled in the art can readily determine the conditions necessary to cure other carbon precursors under the same or different parameters.

In one embodiment the polymerization is not allowed to continue to completion. Terminating the curing process before the entire solution is polymerized can help to form a plurality of intermediate nanostructures that will result in individual nanostructures, rather than a single mass of carbonized material. However, the present invention includes embodiments where the carbon precursor forms a plurality of intermediate carbon nanostructures that are linked or partially linked to one another. In this embodiment, individual nanostructures are formed during carbonization and/or during the removal of amorphous carbon.

Forming intermediate carbon nanostructures from the dispersion of templating nanoparticles causes formation of a plurality of intermediate carbon nanostructures having unique shapes and sizes. Ultimately, the properties of the nanostructure can depend at least in part on the shape and size of the intermediate carbon nanostructure. Because of the unique shapes and sizes of the intermediate carbon nanostructures, the final nanostructures can have beneficial properties such as high surface area and high porosity, among others.

(iii) Carbonizing the Precursor Mixture

The precursor mixture is carbonized by heating to form an intermediate carbon material that includes a plurality of carbon nanostructures, amorphous carbon, and catalyst metal. The precursor mixture can be carbonized by heating the mixture to a temperature between about 500° C. and about 2500° C. During the heating process, atoms such as oxygen and nitrogen are volatilized or otherwise removed from the intermediate nanostructures (or the carbon around the templating nanoparticles) and the carbon atoms are rearranged or coalesced to form a carbon-based structure.

The carbonizing step typically produces a graphite based nanostructure. The graphite based nanostructure has carbon atoms arranged in structured sheets of $sp^2$ hybridized carbon atoms. The graphitic layers can provide unique and beneficial properties, such as electrical conduction and structural strength and/or rigidity.

(iv) Purifying the Intermediate Carbon Material

The intermediate carbon material is purified by removing at least a portion of non-graphitic amorphous carbon. This purification step increases the weight percent of carbon nanostructures in the intermediate carbon material.

The amorphous carbon is typically removed by oxidizing the carbon. The oxidizing agents used to remove the amorphous carbon are selective to oxidation of the bonds found in non-graphitic amorphous carbon but are less reactive to the pi bonds of the graphitic carbon nanostructures. The amorphous carbon can be removed by applying the oxidative agents or mixtures in one or more successive purification steps. Reagents for removing amorphous carbon include oxidizing acids and oxidizing agents and mixtures of these. An example of a mixture suitable for removing amorphous carbon includes sulfuric acid, $KMnO_4$, $H_2O_2$, 5M or greater $HNO_3$, and aqua regia.

Optionally substantially all or a portion of the catalytic metals can be removed. Whether the catalytic metal is removed and the purity to which the catalytic metal is removed will depend on the desired use of the carbon nanomaterial. In some embodiments of the invention, the presence of a metal such as iron can be advantageous for providing certain electrical properties and/or magnetic properties. Alternatively, it may be desirable to remove the catalytic metal to prevent the catalytic metal for having an adverse affect on its ultimate use. Removing the catalytic templating particles can also improve the porosity and/or lower its density.

Typically, the templating nanoparticles are removed using acids or bases such as nitric acid, hydrogen fluoride, or sodium hydroxide. The method of removing the templating nanoparticles or amorphous carbon depends on the type of templating nanoparticle or catalyst atoms in the composite. Catalyst atoms or particles (e.g., iron particles or atoms) can typically be removed by refluxing the composite nanostructures in 5.0 M nitric acid solution for about 3-6 hours.

Any removal process can be used to remove the templating nanoparticles and/or amorphous carbon so long as the removal process does not completely destroy the carbon nanostructures. In some cases it may even be beneficial to at least partially remove some of the carbonaceous material from the intermediate nanostructure during the purification process.

During the purification process, the oxidizing agents and acids can have a tendency to introduce hydronium groups and oxygenated groups such as, but not limited to, carboxylates, carbonyls, and/or ether groups to the surface of the carbonaceous materials. It is believed that the functional groups may be on the surface of the carbon nanostructures, graphite mixed with the carbon nanostructures, and/or remaining non-graphitic amorphous carbon.

(v) Removing Functional Groups From the Surface of the Intermediate Carbon Material Optionally, the functional groups on the surface of the intermediate carbon material can be removed using either a heat treatment step and/or a neutralizing base. Removing the surface functional groups and/or neutralizing the surface functional groups is typically performed in cases where removing and/or neutralizing the functional groups improves the dispersion of the carbon nanomaterial in the polymeric material and/or improves the properties of the composite material.

The functional groups on the surface of the intermediate carbon material can be removed using a heat treatment step. The heat treatment step can be beneficially carried out at a selected temperature, which is selected depending on the particular functional groups that need to be removed. Generally, the higher the temperature of the heat treatment, the more types of functional groups that can be removed. The heat treatment step following purification, can be carried out at a temperature; greater than about 100° C., more preferably greater than about 200° C. and most preferably greater than about 500° C.

Optionally, the heat treatment following purification can be at a temperature sufficient to carry out carbonization of amorphous carbon. Surprisingly, heating the intermediate carbon material to a carbonizing temperature after purification can beneficially convert a significant portion of any remaining amorphous carbon to graphite. It has been found that by removing a significant percentage of amorphous carbon in the purification step and then carbonizing the purified material, the remaining carbon can be more easily converted to graphite.

The graphite formed in this second carbonization step can be added to the carbon nanostructures, the secondary structure of carbon nanostructures (e.g., the grape-like agglomerations of nanospheres), or can be free graphite mixed with the carbon nanostructures. Converting residual amorphous carbon to graphite significantly increases the graphitic purity of the carbon nanomaterial. High purity carbon nanomaterials can be produced more efficiently using the two step carbonization method of the invention compared to attempts to achieve the same level of purity in a single carbonization step.

In an alternative embodiment or in addition to the additional heat treatment step, some functional groups, such as but not limited to hydronium groups, can be removed from the intermediate carbon material using a neutralizing base. In this embodiment, the intermediate carbon material is mixed with a solution that includes one or more neutralizing bases. Suitable bases include hydroxides, including sodium hydroxide and potassium hydroxide, ammonia, Li-acetate, Na-acetate, K-acetate, $NaHCO_3$, $KHCO_3$, $Na_2CO_3$, $K_2CO_3$) and the like, and combinations of these. The reaction of the base with the hydronium group can form byproducts that can be removed by washing with water.

In one embodiment, functional groups are removed by soaking the intermediate carbon material in a washing solution. Additional base can be added to the washing solutions until the pH reaches a desired, more neutral pH. In one embodiment, the washing solution is neutralized to a pH in a range from about 5.0 to about 8.0, or alternatively in a range from about 6.0 to about 7.5.

The step to remove functional groups from the carbon nanomaterial may be used to remove functional groups for the carbon nanostructures, amorphous carbon (graphitic or non-graphitic) or any other component of the purified intermediate carbon material. In one embodiment, the functional groups are removed from the carbon nanostructures or other graphitic materials that form part of the carbon nanomaterial. A high temperature heat treating step can also be beneficial if it is desirable to remove certain impurities such as iron, in addition to removing functional groups from the nanomaterials.

The nanospheres can be manufactured using other suitable technique. Methods for making nanomaterials suitable for use in the present invention are disclosed in applicant's co-pending U.S. application Ser. No. 11/539,120, filed Oct. 5, 2006, entitled "Carbon Nanorings Manufactured From Templating Nanoparticles" and U.S. application Ser. No. 11/539,042, filed Oct. 5, 2006, entitled "Carbon Nanostructures Manufactured From Catalytic Templating Nanoparticles," as well as Han, et al. "Simple Solid-Phase Synthesis of Hollow Graphitic Nanoparticles and their Application to Direct Methanol Fuel Cell Electrodes," Adv. Mater. 2003, 15. No. 22 November 17, all of which are incorporated herein by reference in their entirety.

C. Additives

Additives such as fillers or dispersing agents can be added to the polymeric, material to give the composite desired properties and/or to disperse the carbon nanospheres in the polymeric material. Any filler material can be used with the present invention. Suitable fillers include carbon black, silica, diatomaceous earth, crushed quartz, talc, clay, mica, calcium silicate, magnesium silicate, glass powder, calcium carbonate, barium sulfate, zinc carbonate, titanium oxide, alumina, glass fibers, other carbon fibers, and organic fibers. Other suitable additives include softening agents, plasticizers, molding aids, lubricants, anti-aging agents, and UV absorbing agents.

II. Methods of Making Composites Incorporating Carbon Nanospheres

The composite materials of the present invention are formed by mixing an amount of carbon nanospheres with a polymeric material and optionally one or more additives such as fillers or dispersing agents. The carbon nanospheres can be mixed with the polymeric material in a range of about 0.1% to about 70% by weight of the composite, more preferably in a range of about 0.5% to about 50% by weight, and most preferably in a range of about 1.0% to about 30%.

The carbon nanospheres can be added to the polymeric material in a substantially pure form. Alternatively, the carbon nanospheres can be added to the polymeric material as a component of a carbon nanomaterial. In one embodiment, the carbon nanospheres comprise at least about 2% of the carbon nanomaterial by weight, more preferably at least about 10%, and most preferably at least about 15%.

When mixed with the polymeric materials of the present invention, the carbon nanospheres can provide unique benefits due to the spheroidal shape of the nanospheres. In contrast to carbon nanotubes, which are fiber like, the carbon nanospheres have a more particle-like shape. In some embodiments of the invention, the particle-like shape gives the composite some properties that are more similar to particulate fillers rather than fiber-containing composites.

The carbon nanospheres can be added to the polymeric material in an amount that provides a desired property. For example, the carbon nanospheres can be added to the polymeric material in an amount that imparts electrical conductivity and/or reduces surface resistivity. Surprisingly, the amount of carbon nanospheres needed to produce a desired reduction in electrical surface resistance is substantially less than the amount of carbon nanotubes or carbon black needed to accomplish the same reduction in resistance. It is believed that the carbon nanomaterials provide this improvement, because of a more uniform network of particles that allows improved percolation as compared to carbon nanotubes. Lower surface resistivity is particularly noticeable for polished surfaces. In one embodiment, the polymeric composites of the invention have a surface resistivity in a range from about $1\times10^4$ to about $1\times10^6$ ($\Omega$/sq) with a carbon nanosphere loading in a range from about 0.5 wt % to about 7 wt %, more preferably in a range from about 1 wt % to about 5 wt %.

In addition to electrical conductivity, the carbon nanospheres can be incorporated into polymeric material as a flame retardant.

As a method for producing the composite of the present invention, any known method can be used. In one embodiment of the invention, composites can be manufactured by melting the polymeric materials and then mixing the polymers and carbon nanomaterials together. Alternatively, the polymeric material can be made (i.e., polymerized) while the carbon nanospheres are present.

For example, pellets or powder of the polymeric material and a desired amount of carbon nanospheres can be dry-blended or wet-blended and then mixed in a roll kneader while heating. Alternatively the mixed composite can be fed into an extrusion machine in order to extrude the composite as a rope and then cut it into pellets.

Alternatively, the carbon nanospheres can be blended in a liquid medium with a solution or dispersion of the resin. It is also possible to mix the composite by the Wet Master Batch method. When a thermosetting resin is used, the carbon nanospheres can be mixed with a monomer or oligomer using any known method suitable for the particular polymerizable material.

To improve dispersion of the nanospheres in a polymeric material, any known methods and materials suitable for use with graphitic carbon can be used. Further, as a method for molding into a desired shape, any known method such as extrusion molding, blow molding, injection molding, or press molding can be used.

The composites of the present invention may be made into a foamed product by adding a foaming agent in order to obtain a foamed resin with electrical conductivity and/or blackness. Although any of the aforementioned various polymeric materials can be used for making such foamed product, thermoplastic resins such as polyethylene, polypropylene, polyvinylchloride, polystyrene, polybutadiene, polyurethane, ethylenevinylacetate copolymer, and the like, and thermoplastic polymeric materials are preferable. As a foaming agent, various resin foaming agents, organic solvents, as well as gases such as butane can be used.

Any known method can be used as a method for producing the electroconductive foamed body covered by the present invention. For example, when a thermo-plastic resin is used, the resin is melted and mixed with a desired amount of the carbon nanospheres by an extrusion machine. Then a gas such as butane is injected into the polymeric material. Alternatively, a chemical foaming agent can be used instead of a gas.

The compound covered by the present invention is also useful as a paint to give electrical conductivity and/or blackness to the surface of other substrates. Suitable substrates include various resins, elastomers, rubber, wood, inorganic materials, and the like. In addition these materials can be further molded or formed.

The desirable thickness of the coated film of such compounds covered by the present invention is greater than 0.1 micron.

III. Examples

The following examples provide formulas for making carbon nanomaterials containing carbon nanostructures according to one embodiment of the present invention.

Example 1

Example 1 describes the preparation of a carbon nanomaterial having carbon nanospheres.

(a) Preparation of Iron solution (0.1 M)

A 0.1 M iron solution was prepared by using 84 g iron powder, 289 g of citric acid, and 15 L of water. The iron-containing mixture was mixed in a closed bottle on a shaker table for 3 days, with brief interruptions once or twice daily to purge the vapor space of the bottle with air gas before resuming mixing.

(b) Preparation of Precursor Mixture 916.6 g of resorcinol and 1350 g of formaldehyde (37% in water) were placed to a round bottom flask. The solution was stirred until resorcinol was fully dissolved. 15 L of the iron solution from step; (a), was slowly added with stirring, and then 0.1025 ml of Ammonium hydroxide (28-30% in water) was added drop-wise with vigorous stirring, the pH of the resulted suspension was 10.26. The slurry was cured at 80~90° C. (water bath) for 10 hours. The solid carbon precursor mixture was the collected using filtration and dried in an oven overnight.

(c) Carbonization

The polymerized precursor mixture was placed in a crucible with a cover and transferred to a furnace. The carbonization process was carried out under ample nitrogen flow using the following temperature program: room temperature→1160° C. at a rate of 20° C./min→hold for 5 hrs at 1160° C.→room temperature. The carbonization step yielded an intermediate carbon material having carbon nanostructures, amorphous carbon, and iron.

(d) Purification to Remove Amorphous Carbon and Iron

The purification of the carbonized carbon product (i.e., the intermediate carbon material) was performed as follows: reflux carbonized product in 5M $HNO_3$ for ~12 hrs→rinse with de-ionized (DI)—$H_2O$→treat with a mixture of $KMnO_4$+$H_2SO_4$+$H_2O$ at a mole ratio of 1:0.01:0.003 (keep at ~90° C. for ~12 hrs)→rinse with DI-$H_2O$→treat with 4M HCl (keep at ~90° C. for ~12 hrs)→rinse with Di-$H_2O$→collect the product and dry in the oven at ~100° C. for two days.

(e) Heat Treatment to Reduce Surface Functional Groups

After the purification procedure, the carbon product went through heat treatment to minimize the surface functional groups and increase the graphitic content. The temperature program that was used for this treatment was as follows: heat from room temperature at 4° C./min→100° C. hold at 100° C. for 2 hrs→250° C. at 15° C./min→hold for 2 hrs at 250° C.→1000° C. at 15° C./min→hold at 1000° C. for 2 hrs→room temperature. The heat treatment process yielded a carbon nanomaterial primarily composed of carbon nanospheres.

The carbon nanomaterial manufactured in Example 1 was then analyzed by SEM and TEM. The SEM images of the carbon nanostructures are shown in FIGS. 1A and 1B, which reveal a plurality of carbon nanospheres that agglomerate to form a cluster that has a grape-like shape. The TEM images in FIGS. 2 and 3 show that the grape-like clusters are made up of a plurality of small, hollow graphitic nanostructure or carbon nanospheres.

Figure 4:
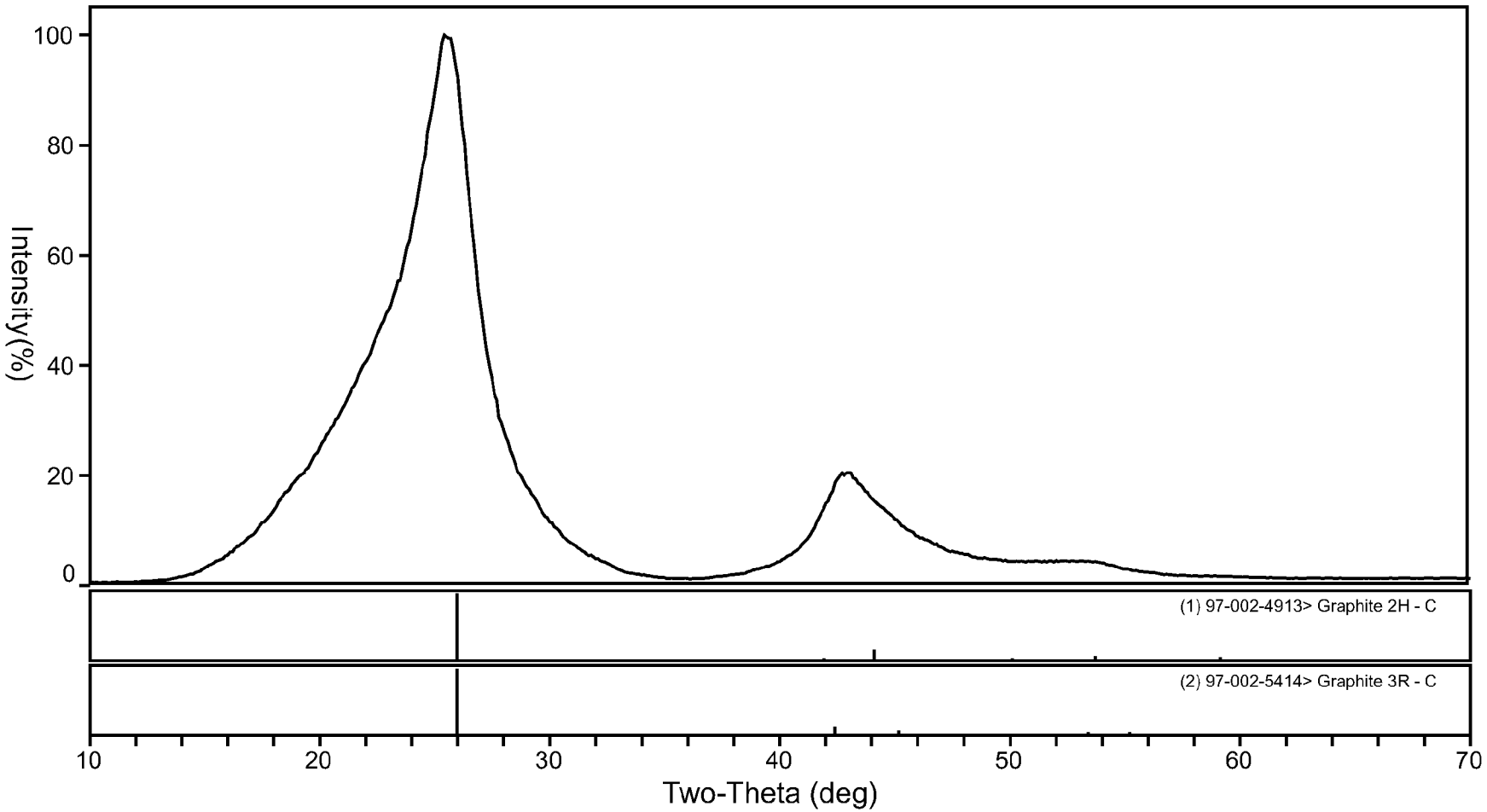
FIG. 4 shows the intensity of x-ray diffraction of the carbon nanomaterial of FIG. 1A.

The carbon nanostructures of Example 1 were tested for graphitic content using X-ray diffraction. FIG. 4 is a graph showing the X-ray diffraction pattern of the carbon nanomaterial of Example 1. The broad peak at about 26° is due to the short range order of graphitic nanostructures. This is in contrast to the typical diffraction pattern of graphite sheets, which tend to have a very narrow peak. The broad peak at about 26° also suggests that the material is graphitic, since amorphous carbon tends to have a diffraction peak at 20°.

Figure 5:
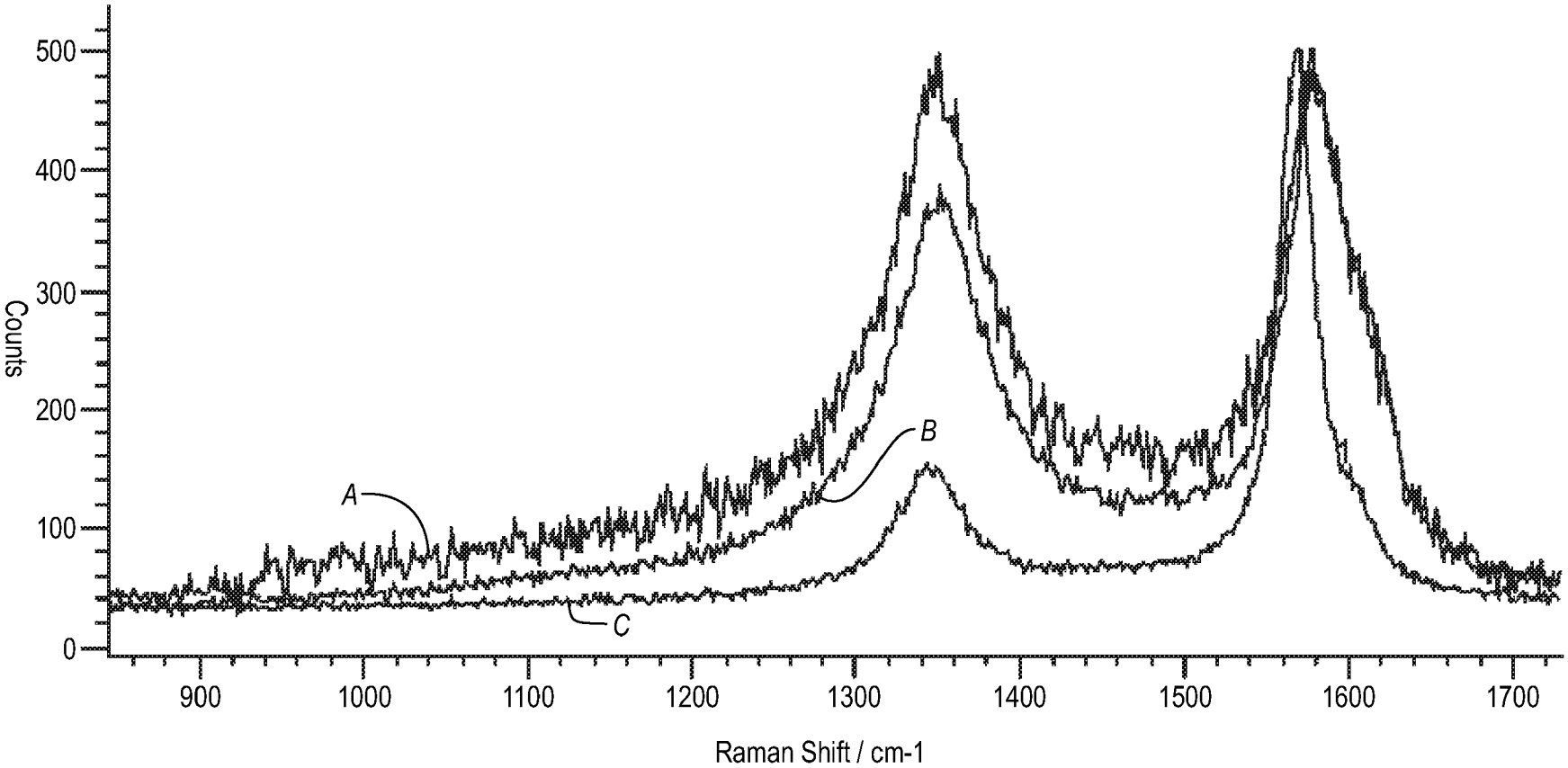
FIG. 5 is a graph showing the Raman spectra of a carbon nanomaterial manufactured according to the present invention and showing differences in the carbon nanomaterial as a result of different heat treatments.

Raman spectroscopy was used to determine the graphitic content of the carbon nanomaterial at different temperatures during the heat treating step (e). Sample A was taken from the carbon nanomaterial at a heat treated temperature of 1000° C., Sample B was taken during heat treating to 600° C., and Sample C was a sample with no heat treating (i.e., Sample C was the purified intermediate carbon material of step (d)). The results for Raman Spectroscopy are shown in FIG. 5. The graph in FIG. 5 has two significant peaks, one at 1354 $cm^{-1}$, and the other at 1581 $cm^{-1}$. As shown in the graph, Sample A and B, which were heat treated, have larger peaks at 1354 $cm^{-1}$. These peaks indicate that the amorphous carbon is graphitic and therefore is not burnt off (i.e. there is less mass loss). In contrast, the peak at 1354 $cm^{-1}$ for Sample C shows significant mass loss, which is indicative of non-graphitic amorphous carbon. Thus, in addition to removing functional groups, the heat treatment step is effective for increasing the graphitic content of any remaining carbon. Surprisingly this conversion can happen at relatively low temperatures, for example, between 500° C. and 1400° C.

The higher graphitic content of carbon nanomaterial manufactured according to the present invention using an additional heat treatment step results in a carbon nanomaterial with superior conductive properties and purity. In addition to improving the graphite concentration, heat treating was also shown to substantially reduce other impurities such as iron.

Example 2

Example 2 describes a carbon nanomaterial manufactured using the same method as Example 1, except that in step (e) the heat treatment step was replaced with a treatment using a neutralizing base.

A portion of the purified carbon material obtained in step (d) of Example (1) was mixed with ample amount of DI-$H_2O$, followed by drop-wise addition of 5M NaOH to adjust the pH of the solution to ~7.0. The resulting carbon nanomaterial was collected by filtration and rinsed with ample amount of DI-$H_2O$ to remove $Na^+$ ions. The final product was collected and dry in an oven at ~100° C. for two days.

Example 3

Comparative Example

For comparison purposes, a portion of the purified carbon material obtained in step (d) of Example 1 was collected and was not subject to the heat treatment step described in step (e) of Example 1, nor was it subjected to a neutralizing base as in Example 2.

Figure 6:
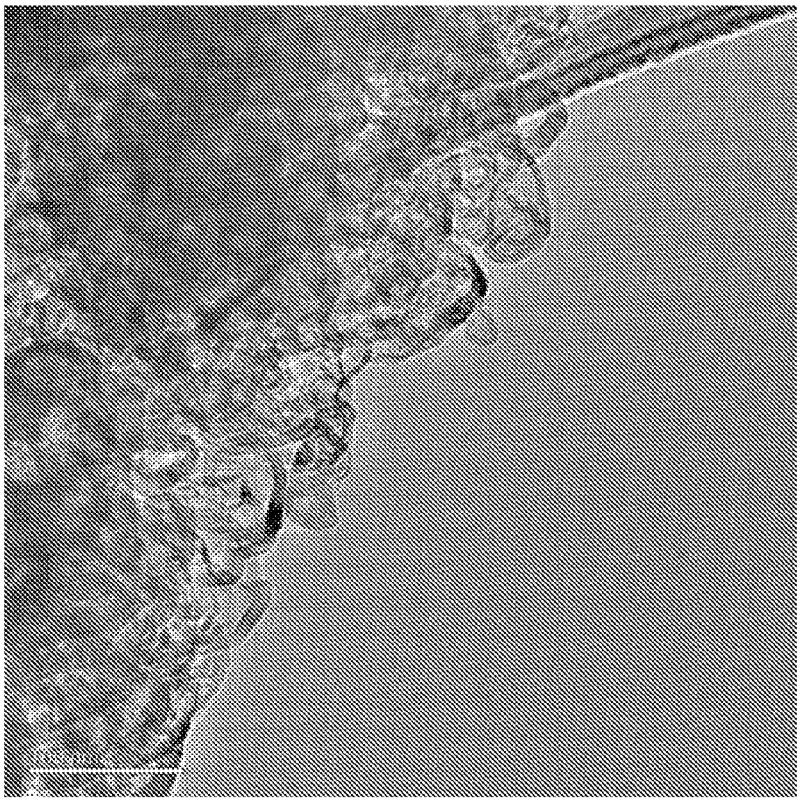
FIG. 6 is a high resolution TEM of a purified intermediate carbon material manufactured according to the invention, but that has not been treated to remove functional groups.
Figure 7:
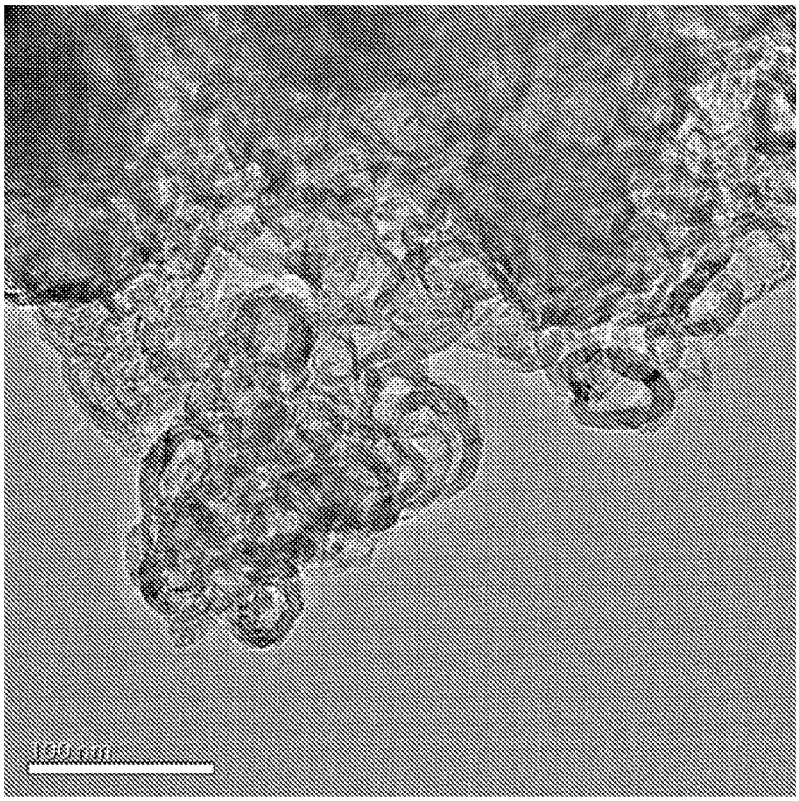
FIG. 7 is a high resolution TEM of the carbon nanomaterial of FIG. 6 that has been treated with a base to remove functional groups.

TEM images of the carbon nanostructures of Examples 2 and 3 were obtained to determine if any structural changes occur during the neutralizing step. FIG. 7, which is a TEM of the carbon material of Example 2 (i.e., after neutralization), shows no deleterious effects on the carbon nanostructures when compared to FIG. 6, which is a TEM of the carbon material of Example 3 (i.e., before neutralization).

Figure 8:
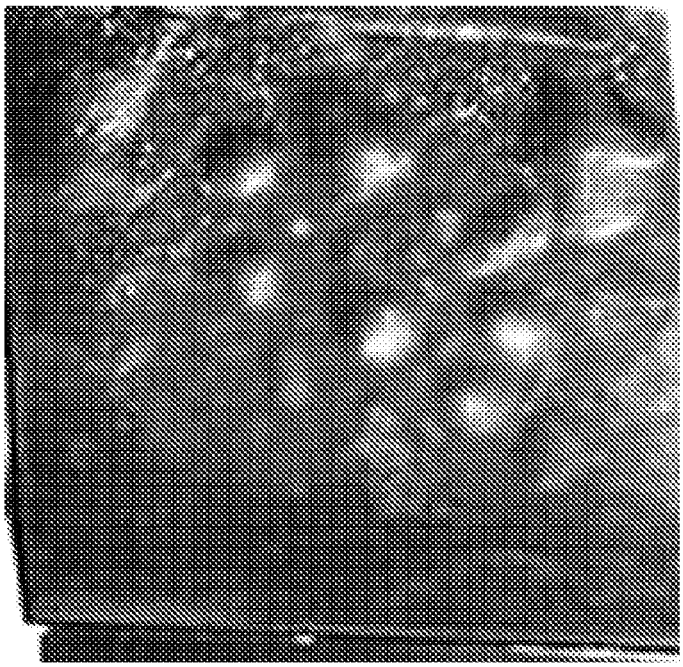
FIG. 8 is an image of a polymer with the purified intermediate carbon material of FIG. 6 incorporated therein.
Figure 9:
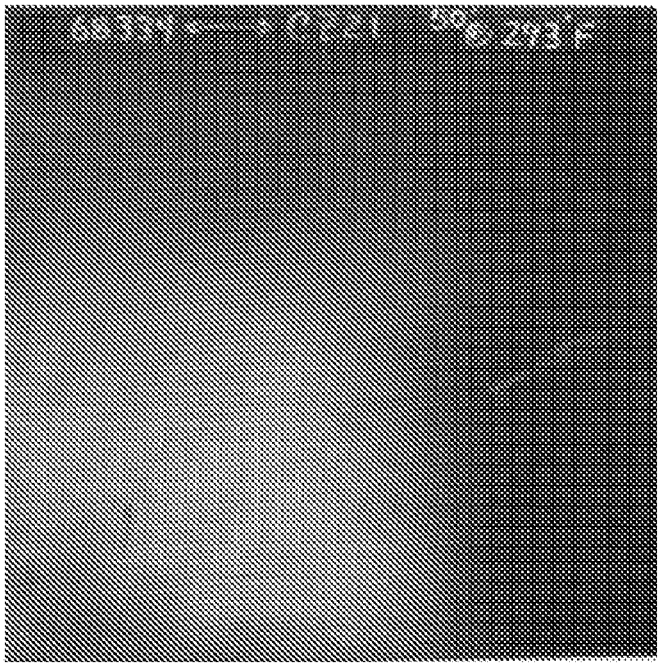
FIG. 9 is an image of a polymer with the carbon nanomaterial of FIG. 7 incorporated therein.

The beneficial properties of the acid-free carbon nanomaterial of Example 2 can be illustrated by incorporating the acid-free nanomaterial into a polymer and comparing it to polymers that include nanomaterials that are identical except for the presence of acid functional groups. To test this scenario, the carbon nanomaterials of Examples 2 and 3 where separately mixed with a polymer. FIG. 8 shows the polymer with the carbon nanomaterial having acid functional groups. This polymer shows significant blistering and irregularities on its surface. In contrast, the polymer that includes the neutralized carbon nanomaterials of Example 2 show a smooth surface.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A composite material comprising:

a polymeric material comprising a polymer or a polymerizable material; and a plurality of carbon nanospheres dispersed in the polymeric material, wherein the carbon nanospheres comprise at least about 0.1% by weight of the composite material, wherein the carbon nanospheres comprise hollow, multi-walled particles having multiple graphitic layers with an outer diameter of less than about 1 micron, wherein the carbon nanospheres have an absence of surface functional groups.

2. A composite material as in claim 1, wherein the carbon nanospheres comprise at least about 0.5% by weight of the composite material.

3. A composite material as in claim 1, wherein the carbon nanospheres comprise at least about 1% by weight of the composite material.

4. A composite material as in claim 1, further comprising carbon nanomaterials other than and in addition to the carbon nanospheres, wherein the carbon nanospheres comprise at least about 2% by weight of the total amount of carbon nanomaterial in the composite.

5. A composite material as in claim 4, wherein the carbon nanospheres comprise at least about 3% by weight of the total amount of carbon nanomaterial in the composite.

6. A composite material as in claim 4, wherein the carbon nanospheres comprise at least about 15% by weight of the total amount of carbon nanomaterial in the composite.

7. A composite material as in claim 1, wherein the polymeric material comprises a polymer selected from the group consisting of polyamines, polyacrylates, polybutadienes, polybutylenes, polyethylenes, polyethylenechlorinates, ethylene vinyl alcohols, fluoropolymers, ionomers, polymethylpentenes, polypropylenes, polystyrenes, polyvinylchlorides, polyvinylidene chlorides, polycondensates, polyamides, polyamide-imides, polyaryletherketones, polycarbonates, polyketones, polyetheretherketones, polyetherimides, polyethersulfones, polyimides, polyphenylene oxides, polyphenylene sulfides, polyphthalamides, polythalimides, polysulfones, polyarylsulfones allyl resins, melamine resins, phenol-formaldehyde resins, liquid crystal polymers, polyolefins, polyesters, silicones, polyurethanes, epoxies, cellulosic polymers, and combinations thereof.

8. A composite material as in claim 1, wherein the polymeric material comprises a thermo-plastic polymeric material selected from the group consisting of acrylonitrile-butadiene-styrene, acrylonitrile-ethylene/propylene-styrene, methylmethacrylate-butadiene-styrene, acrylonitrile-butadiene-methylmethacrylate-styrene, acrylonitrile-n-butylacrylate-styrene, rubber modified polystyrene, polyethylene, polypropylene, polystyrene, polymethyl-methacrylate, polyvinylchloride, cellulose-acetate resin, polyamide, polyester, polyacrylonitrile, polycarbonate, polyphenyleneoxide, polyketone, polysulphone, polyphenylenesulfide, fluoride resin, silicone, polyimide, polybenzimidazole, polyamide elastomer, and combinations thereof.

9. A composite material as in claim 1, wherein the polymeric material comprises a thermo-setting polymeric material selected from the group consisting of phenol resin, urea resin, melamine-formaldehyde resin, urea-formaldehyde latex, xylene resin, diallylphthalate resin, epoxy resin, aniline resin, furan resin, polyurethane, and combinations thereof.

10. A composite material comprising a polymeric material comprised of a polymer or a polymerizable material and a carbon nanomaterial mixed therewith, wherein the carbon nanomaterial comprises carbon nanospheres that include hollow, multi-walled particles having multiple graphitic layers with an outer diameter of less than about 1 micron and have an absence of surface functional groups, wherein the carbon nanospheres comprise at least about 0.1% by weight of the composite material, wherein the carbon nanomaterial is manufactured according to a method comprising:

forming a precursor mixture comprising a carbon precursor and a plurality of templating nanoparticles, the templating nanoparticles comprising a catalytic metal;

carbonizing the precursor mixture to form an intermediate carbon material comprising a plurality of carbon nanostructures, amorphous carbon, and optionally remaining catalytic metal;

purifying the intermediate carbon material by removing at least a portion of the amorphous carbon and optionally a portion of remaining catalytic metal to yield a purified intermediate carbon material comprising carbon nanospheres; and removing functional groups from a surface of the purified intermediate carbon material.

11. A composite material as in claim 10, wherein removing functional groups from a surface of the purified intermediate carbon material comprises:

(i) heating the purified intermediate carbon material to a temperature greater than about 100° C.; and/or (ii) treating the purified intermediate carbon material with a base.

12. A composite material as in claim 11, wherein removing functional groups from a surface of the purified intermediate carbon material comprises heating the purified intermediate carbon material to a temperature greater than about 200° C.

13. A composite material as in claim 11, wherein removing functional groups from a surface of the purified intermediate carbon material comprises heating the purified intermediate carbon material to a temperature greater than about 500° C.

14. A composite material as in claim 11, wherein removing functional groups from a surface of the purified intermediate carbon material comprises heating the purified intermediate carbon to a temperature greater than about 1000° C.

15. A composite material as in claim 11, wherein removing functional groups from a surface of the purified intermediate carbon material comprises treating the purified intermediate carbon material with sodium hydroxide and/or potassium hydroxide.

16. A composite material as in claim 10, wherein the composite comprises a polymer selected from the group consisting of acrylonitrile-butadiene-styrene, acrylonitrile-ethylene/propylene-styrene, methylmethacrylate-butadiene-styrene, acrylonitrile-butadiene-methylmethacrylate-styrene, acrylonitrile-n-butylacrylate-styrene, rubber modified polystyrene, polyethylene, polypropylene, polystyrene, polymethyl-methacrylate, polyvinylchloride, cellulose-acetate resin, polyamide, polyester, polyacrylonitrile, polycarbonate, polyphenyleneoxide, polyketone, polysulphone, polyphenylenesulfide, fluoride resin, silicone, polyimide, polybenzimidazole, polyamide elastomer, and combinations thereof.

17. A composite material comprising a polymer and a carbon nanomaterial mixed therewith, wherein the composite material is manufactured according to a method comprising:

heating a thermoplastic polymer to a temperature above the polymer's melting point or glass transition temperature;

mixing between about 1% and about 50% by weight of a graphitic material into the heated polymer, the graphitic material comprising greater than 3% by weight of carbon nanospheres, the carbon nanospheres comprising hollow, multi-walled particles having multiple graphitic layers with an outer diameter of less than about 1 micron and having an absence of surface functional groups; and allowing the thermoplastic polymer to cool to yield the composite material, wherein the carbon nanospheres comprise at least about 0.1% by weight of the composite material.

18. A composite material as in claim 17, wherein the polymer is selected from the group consisting of acrylonitrile-butadiene-styrene, acrylonitrile-ethylene/propylene-styrene, methylmethacrylate-butadiene-styrene, acrylonitrile-butadiene-methylmethacrylate-styrene, acrylonitrile-n-butylacrylate-styrene, rubber modified polystyrene, polyethylene, polypropylene, polystyrene, polymethyl-methacrylate, polyvinylchloride, cellulose-acetate resin, polyamide, polyester, polyacrylonitrile, polycarbonate, polyphenyleneoxide, polyketone, polysulphone, polyphenylenesulfide, fluoride resin, silicone, polyimide, polybenzimidazole, polyamide elastomer, and combinations thereof.

19. A composite material as in claim 17, wherein the carbon nanospheres are manufactured by a method comprising:

(i) forming one or more intermediate carbon nanospheres by polymerizing a carbon precursor in the presence of a plurality of templating nanoparticles;

(ii) carbonizing the intermediate carbon nanospheres to form a plurality of composite nanostructures; and (iii) optionally removing the templating nanoparticles from the composite nanostructures to yield the carbon nanospheres.

20. A composite material as in claim 19, wherein the templating nanoparticles comprise at least one of iron, nickel, or cobalt.

21. A composite material as in claim 19, wherein carbonization is carried out at a temperature between about 500° C. and about 2500° C.

22. A composite material as in claim 19, wherein the templating nanoparticles are removed from the composite nanostructure by etching with an acid, a base, or both.

23. A composite material comprising a polymer and a graphitic material mixed therewith, wherein the composite material is manufactured according to a method comprising:

mixing between about 1% and 50% by weight of a graphitic material with a polymerizable material, the graphitic material comprising at least about 3% by weight of carbon nanospheres, the carbon nanospheres comprising hollow, multi-walled particles having multiple graphitic layers with an outer diameter of less than about 1 micron and an absence of surface functional groups; and polymerizing the polymerizable material to form a polymeric material having the carbon nanospheres dispersed therein, wherein the carbon nanospheres comprise at least about 0.1% by weight of the composite material.

24. A composite material as in claim 23, wherein the polymerizable material comprises a monomer or oligomer suitable for forming a polymer selected from the group consisting of polyacrylates, polybutadienes, polybutylenes, polyethylenes, polyethylenechlorinates, ethylene vinyl alcohols, fluoropolymers, ionomers, polymethylpentenes, polypropylenes, polystyrenes, polyvinylchlorides, polyvinylidene chlorides, polycondensates, polyamides, polyamide-imides, polyaryletherketones, polycarbonates, polyketones, polyetheretherketones, polyetherimides, polyethersulfones, polyimides, polyphenylene oxides, polyphenylene sulfides, polyphthalamides, polythalimides, polysulfones, polyarylsulfones allyl resins, melamine resins, formaldehyde resins, liquid crystal polymers, polyolefins, polyesters, silicones, polyurethanes, epoxies, cellulosic polymers, and combinations thereof.

25. A composite material comprising:

a polymeric material comprising a polymer or a polymerizable material; and a plurality of carbon nanospheres dispersed in the polymeric material, wherein the carbon nanospheres comprise at least about 0.1% by weight of the composite material, wherein the carbon nanospheres comprise hollow, multi-walled graphitic particles having multiple graphitic layers and a BET specific surface area greater than about 120 $m^2/g$, wherein the carbon nanospheres have an outer diameter of less than about 1 micron and an absence of surface functional groups.

* * * * *